US011837769B2

(12) United States Patent
Qasymeh et al.

(10) Patent No.: US 11,837,769 B2
(45) Date of Patent: Dec. 5, 2023

(54) SYSTEM FOR COHERENT MICROWAVE TRANSMISSION USING A NON-REFRIGERATED WAVEGUIDE

(71) Applicant: Abu Dhabi University, Abu Dhabi (AE)

(72) Inventors: Montasir Yousof Abdallah Qasymeh, Abu Dhabi (AE); Hichem El Euch, Abu Dhabi (AE)

(73) Assignee: Abu Dhabi University, Abu Dhabi (AE)

( * ) Notice: Subject to any disclaimer, the term of this patent is extended or adjusted under 35 U.S.C. 154(b) by 408 days.

(21) Appl. No.: 17/352,399

(22) Filed: Jun. 21, 2021

(65) Prior Publication Data

US 2022/0407201 A1 Dec. 22, 2022

(51) Int. Cl.

| | |
|---|---|
| ***H01P 3/00*** | (2006.01) |
| ***H01P 1/30*** | (2006.01) |
| ***H01Q 7/00*** | (2006.01) |
| ***H01Q 1/36*** | (2006.01) |

(52) U.S. Cl.

CPC ..... *H01P 1/30* (2013.01); *H01Q 1/364* (2013.01); *H01Q 7/00* (2013.01)

(58) Field of Classification Search

CPC .. H01P 3/00; H01P 3/003; H01P 3/006; H01P 3/02; H01P 3/023; H01P 3/026; H01P 3/12; H01P 3/121; H01P 1/30; H01P 11/00; H01P 11/001; H01P 11/002; H01P 11/003

See application file for complete search history.

(56) References Cited

U.S. PATENT DOCUMENTS 8,213,476 B1 * 7/2012 Wanke ..... G02B 6/1228 372/50.1
10,483,610 B2 * 11/2019 U-Yen ..... H01L 23/552

OTHER PUBLICATIONS

Severin Dias, et al., A Quantum Logic Gate between Distant Quantum Network Modules, Science, Feb. 5, 2021, pp. 614-617, vol. 371, AAAS, Washington DC, USA.

Youpeng Zhong, et al, Deterministic Multi-Qubit Entanglement in a Quantum Network, Nature, Feb. 25, 2021, pp. 571-575, vol. 590, Macmillan Publishers Limited, New York, USA.

P. Magnard, et al., Microwave Quantum Link between Superconducting Circuits Housed in Spatially Separated Cryogenic Systems, Physical Review Letters, Dec. 20, 2020, pp. 260502-1 to 260502-7, vol. 125, American Physical Society, College Park, USA.

John G. Bartholomew, et al., On-Chip Coherent Microwave-to-Optical Transduction Meditated by Ytterbium in YVO4, Nature Communications, Jun. 29, 2020, pp. 1-6, vol. 11-3266, Macmillan Publishers Limited, New York, USA.

Daniel Gottesman and Isaac L. Chuang, Demonstrating the Viability of Universal Quantum Computation Using Teleportation and Single Qubit Operations, Nature, Nov. 25, 1999, pp. 390-393, vol. 402, MacMillan Magazines, New York, USA.

T.E. Northrup and R. Blatt, Quantum Information Transfer Using Photons, Nature Photonics, Apr. 25, 2014, pp. 356-363, vol. 8, Macmillan Publishers Limited, New York, USA.

(Continued)

*Primary Examiner* — Hai L Nguyen

(57) ABSTRACT

An apparatus, including a waveguide, a first circuit, a second circuit. The waveguide is connected to the first circuit and the second circuit. The first circuit is located within a cryostat.

9 Claims, 11 Drawing Sheets

(56) References Cited

OTHER PUBLICATIONS

Liang Jang, et al., Distributed Quantum Computation Based on Small Quantum Registers, Physical Review A, Dec. 26, 2007, pp. 062323-1 to 062323-22, vol. 76, American Physical Society, College Park, USA.
C. Monroe, et al.., Large-Scale Modular Quantum-Computer Architecture with Atomic Memory and Photonic Interconnects, Physical Review A, Feb. 13, 2014, pp. 022317-1 to 022317-16, vol. 89, American Physical Society, College Park, USA.
S. Krinner et al., Engineering Cryogenic Setups for 100-Qubit Scale Superconducting Circuit Systems, EPJ Quantum Technology, May 28, 2019, pp. 1-29, vol. 6:2, Springer, New York, USA.
T.D. Ladd, et al., Quantum Computers, Nature, Mar. 4, 2010, pp. 45-53, vol. 464, Macmillan Publishers Limited, New York, USA.
David Awschalom, et al., Development of Quantum Interconnects (QuICs) for Next Generation information Technologies, PRX Quantum, Feb. 24, 2021, pp. 017002-1 to 017002-21, vol. 2, American Physical Society, College Park, USA.
H.J. Kimble, The Quantum Internet, Nature, Jun. 19, 2008, pp. 1023-1030, vol. 453, Macmillan Publishers Limited, New York, USA.
Stephanie Wehner and David Elkouss and Ronald Hanson, Quantum Internet: A Vision for the Road Ahead, Science, Oct. 19, 2018, pp. 1-9, vol. 362, AAAS, Washington DC, USA.
L.J. Stephenson, et al., High-Rate, High Fidelity Entanglement of Qubits Across an Elementary Quantum Network, Physical Review Letters, Mar. 16, 2020, pp. 110501-1 to 110501-6, vol. 124, American Physical Society, College Park, USA.
Zheshan Zhang, et al., Entanglement-Enhanced Sensing in a Lossy and Noisy Environment, Physical Review Letters, Mar. 20, 2015, pp. 110506-1 to 110506-6, vol. 114, American Physical Society, College Park, USA.
J.E. Mooji, et al., Josephson Persistent-Current Qubit, Science, Aug. 13, 1999, pp. 1036-1039, vol. 285, AAAS, Washington, DC, USA.
Frank Arute, et al., Quantum Supremacy using a Programmable Superconducting Processor, Nature, Oct. 24, 2019, pp. 505-511, vol. 574, Springer Nature Limited, London, United Kingdom.
Christopher J. Axline, et al., On-Demand Quantum State Transfer and Entanglement Between Remote Microwave Cavity Memories, Nature Physics, 2018, pp. 1-8, no volume cited, Macmillan Publishers Limited, New York, USA.
P. Kurpiers, et al., Deterministic Quantum State Transfer and Remote Entanglement using Microwave Photons, Nature, Jun. 14, 2018, pp. 1-17, vol. 558, Macmillan Publishers Limited, New York, USA.
Youpeng Zhong, et al., Deterministic Multi-Qubit Entanglement in a Quantum Network, Nature, Feb. 25, 2021, pp. 1-6, vol. 590, Springer Nature Limited, London, United Kingdom.
A. Bienfait, et al., Phonon-Mediated Quantum State Transfer and Remote Qubit Entanglement, Science, Apr. 26, 2019, pp. 368-371, vol. 364 (6438), AAAS, Washington DC, USA.
J. Gambetta, IBM's Roadmap for Scaling Quantum Technology, IBM Research Blog, Sep. 15, 2020, pp. 1-7, no volume cited, IBM, Armonk, USA.
Montasir Qasymeh and Hichem El Euch, Quantum Microwave-to-Optical Conversion in Electrically Driven Multilayer Graphene, Optics Express, Mar. 4, 2019, pp. 5945-5960, vol. 27, No. 5, Optica, Washington DC, USA.
Mohammad Mirhosseini, et al., Superconducting Qubit to Optical Photon Transduction, Nature, Dec. 23, 2020, pp. 599-612, vol. 588, Springer Nature Limited, London, United Kingdom.
Ming Gong, et al., Quantum Walks on a Programmable Two-Dimensional 62-Qubit Superconducting Processor, Science, May 28, 2021, pp. 948-952, vol. 372, AAAS, Washington DC, USA.
Gideon Lichfield, Inside the Race to Build the Best Quantum Computer on Earth, MIT Technology Review, Feb. 26, 2020, pp. 1-19, vol. Mar./Apr. 2020, MIT, Cambridge, USA.
John Levy, 1 Million Qubit Computers: Moving Beyond the Current "Brute Force" Strategy, SEEQC, 2020, pp. 1-4, no volume cited, SEEQC, Elmsford, NY, USA.
C. Macklin, et al., A Near Quantum-Limited Josephson Traveling Wave Parametric Amplifier, Sciencexpress/Science, Sep. 3, 2015, pp. 1-8, vol. 350, AAAS, Washington, DC, USA.
Udson C. Mendes, et al., Parametric Amplification and Squeezing with an AC- and DC-Voltage Biased Superconducting Junction, Physical Review Applied, Mar. 14, 2019, pp. 034035-1 to 034035-13, vol. 11, American Physical Society, College Park, USA.

* cited by examiner

SYSTEM FOR COHERENT MICROWAVE TRANSMISSION USING A NON-REFRIGERATED WAVEGUIDE

BACKGROUND

Quantum microwave transmission is a requirement of modular superconducting quantum computers and distributed quantum networks. Realizing large-scale quantum computers with thousands (or millions) of qubits requires coherent quantum transmission between distant quantum nodes.

This architecture of remotely connecting quantum modules, also known as the modular quantum computer, is believed to overcome the current challenges that obstacle scaling up quantum computers, such as cross talks, input/output coupling limitations, and bound space. Quantum sensing and networks require coherent quantum transmissions with applicable implementation of superconducting based quantum circuits (which have shown exceptional potential for quantum signal processing and computation). However, the superconducting signals are fragile against the thermal energy as they operate at the microwave frequency spectrum. Therefore, superconducting circuits are typically housed in cryostats-refrigeration.

One existing approach is based on entangling distant superconducting circuits using coaxial cables carrying microwave photons or acoustic channels carrying phonons. The reported transmission lengths using this technique is between one and two meters. Another existing approach uses a cooled microwave waveguide at cryogenic temperature. Where a five meters coherent microwave transmission was reported. The above two approaches require housing the transmission channels in dilution refrigerators, which require substantial financial and logistical investments.

Adding qubit for a superconducting quantum computer requires connecting considerable number of cables, and related components, which imposes an overwhelming heating load. For example, the cost per qubit is estimated to be about $10,000 to maintain the required cryogenic refrigeration while handling the pertinent cabling connections. It then follows that the cost of a scaled quantum computer that utilizes a giant dilution refrigerator is expected to be in the billions of dollars. Currently, there is no system or method for transmitting coherent quantum microwave fields at room temperature.

DETAILED DESCRIPTION OF PREFERRED EMBODIMENTS

The following detailed description refers to the accompanying drawings. The same reference numbers in different drawings may identify the same or similar elements.

Systems, devices, and/or methods described herein may provide for coherent microwave transmission using a microwave waveguide at room temperature. In embodiments, the systems, devices, and/or methods described herein, include two cryogenic nodes (e.g., transmitter and receiver) connected by a room temperature microwave waveguide. In embodiments, at the receiver side, a cryogenic loop antenna coupled to an LC harmonic oscillator (with L representing an inductor and C representing a capacitor) is implemented inside an output port of the waveguide, while the LC harmonic oscillator is located outside the waveguide. In embodiments, the loop antenna converts quantum microwave fields (which include both signal and thermal noise photons) to quantum voltage across the coupled LC harmonic oscillator.

Accordingly, the loop antenna can be designed so that (1) the number of detected noise photons can be significantly made less than one, and (2) the detected signal photons can be maintained sufficiently greater than one by transmitting large enough number of photons at an input port of the waveguide. In a non-limiting example, we have shown that for a 10 GHz microwave signal, coherent photons are received using meters room temperature waveguide by transmitting $8\times10^4$ signal photons at the waveguide input. In this non-limiting example, the number of the noise photons is maintained as small as $2.6\times10^{1}$, while 8 coherent signal photons are received.

In embodiments, by further providing a level of cooling for the connecting waveguide, the proposed coherent transmission system can be extended to larger distances (e.g., the distance being the length of the waveguide). In a non-limiting example, by cooling the transmission waveguide to the liquid air temperature to 78 K, the same number of 8 coherent signal photons can be achieved with $5.4\times10^{-3}$ noise photons for a 35 meters waveguide length by transmitting $8\times10^4$ photons. Accordingly, these example designs can allow modular quantum computers with a much simpler architecture.

Figure 1:
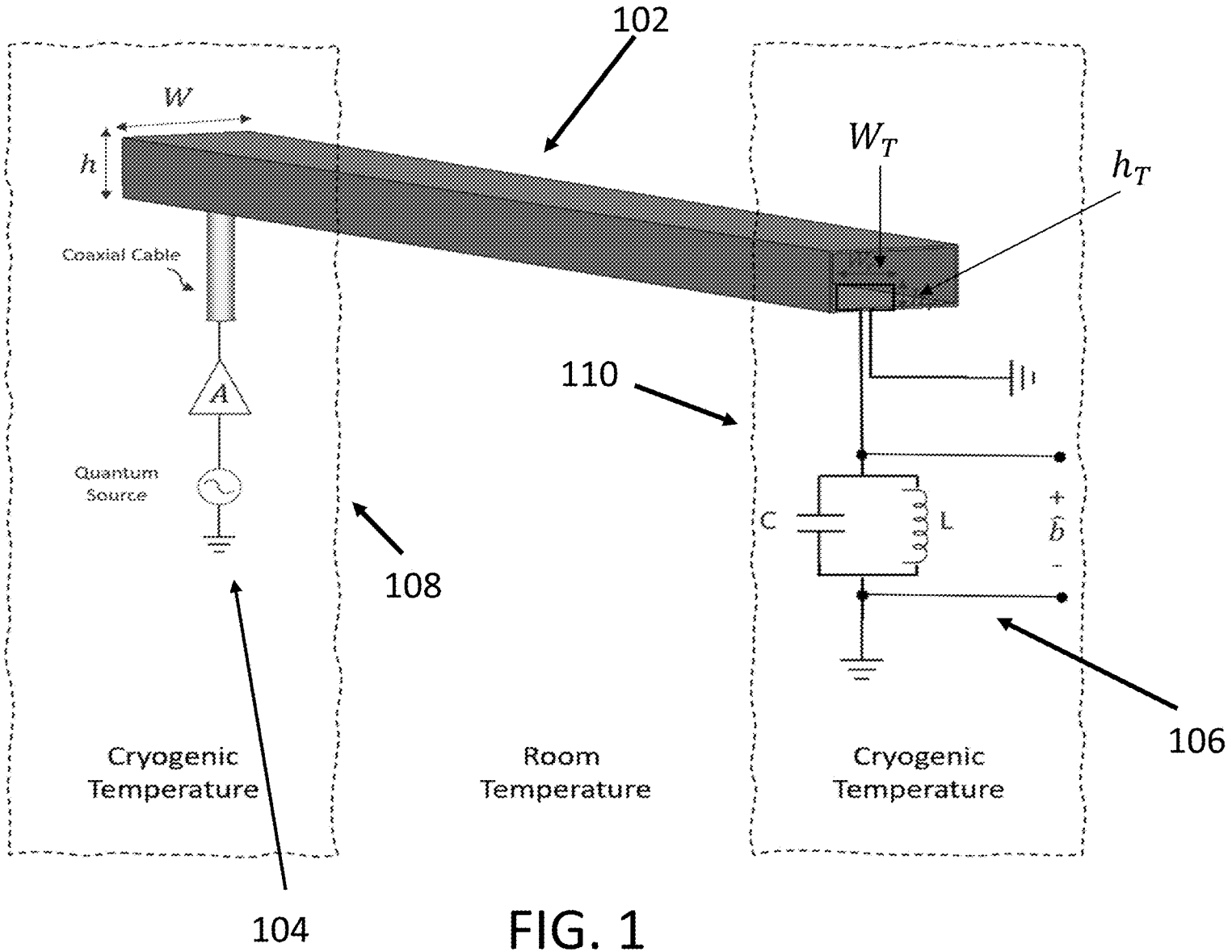
FIG. 1 is a diagram of an example microwave transmission system using a room temperature waveguide.

FIG. 1 shows an example system 100 that includes a microwave waveguide 102, connecting two distant superconducting circuits housed in cryostats, 104 and 106, while the waveguide is placed outside the refrigeration and operates at room temperature. In embodiments, room temperature may be 20 degrees Celsius. However, in other embodiments, other temperatures (plus or minus 5 degrees, plus or minus 1 degree, plus or minus 3 degrees, etc.) may be considered as room temperature In embodiments, system 100 allows for coherent quantum microwave fields to be transmitted using a room temperature microwave waveguide. In embodiments, the principle of operation is based on utilizing a superconducting loop antenna, that is coupled to an LC harmonic oscillator 106, at the receiving end of the transmission waveguide.

In embodiments, conducted by the principle of Faraday's Law of Induction, the loop antenna converts the microwave fields to microwave voltages across LC harmonic oscillator 106. In embodiments, the induced voltages in LC harmonic oscillator 106 include both a transmitted signal and a thermally generated noise. Furthermore, by designing the loop antenna at particular dimensions, the number of induced noise photons in LC harmonic oscillator 106 can be made significantly smaller than one.

However, in embodiments, the number of induced signal photons in LC harmonic oscillator 106 can be maintained by transmitting a particular number of photons at the input port 104 of the waveguide (e.g., by using a cryogenic per-amplifications). Accordingly, as shown in FIG. 1, the proposed scheme allows for microwave waveguide 102 to operate at room temperature while connecting two superconducting quantum circuits, 104 and 106, housed in distant separated cryostats 108 and 110. In embodiments, cryostats 108 and 110 can maintain cryogenic temperatures (e.g., 93 K (Kelvin) or below). In embodiments, cryostats 108 and 110 may be closed-cycle cryostats, continuous-flow cryostats, bath cryostats, multi-stage cryostats, and or any other type of cryostats. Thus, the system described in FIG. 1 allows for a modular superconducting quantum computer (or a local quantum network) without any need for transduction or waveguides cooling.

As described in FIGS. 2A, 2B, 3A, 3B, 4A and 4B, for the system described in FIG. 1, analysis is made using an example aluminum waveguide that supports Transverse Electric (TE) fundamental propagation mode.

In embodiments, a motion equation of the propagating $TE_{10}$ mode in the microwave waveguide is $$\frac{\partial \hat{u}t}{\partial t} = -\frac{\Gamma}{2}\hat{u}(t) + \sqrt{\Gamma}\,\hat{n}(t),$$

where $\hat{u}$ is an annihilation operator of the $TE_{10}$ mode, is a decay coefficient, $\hat{n}(t)$ is a quantum Langevin noise operator that obeys the relation $$\langle n(t_1)^{\dagger} n(t_2)\rangle = n_{th}\delta(t_1 - t_2) \text{ and } n_{th} = \frac{1}{\exp\left(\frac{h_\omega}{k_B T}\right) - 1}.$$

In embodiments, the expression of the field operator $\hat{u}(t)$ at the output of the rectangular waveguide is given by equation (1):

$$\hat{u}(t) = \hat{u}(0)e^{-\frac{\Gamma}{2}t} + \sqrt{\Gamma}\,e^{-\frac{\Gamma}{2}t}\int_0^t e^{-\frac{\Gamma}{2}\tau}\hat{n}(\tau)d\tau$$

In embodiments, $$t = \frac{l}{v_g}$$

is the interaction propagation time, l is a waveguide length, and $v_g$ is a group velocity of the $TE_{10}$ mode. In embodiments, by using the system in FIG. 1 and the quantum Langevin noise properties, the number of photons of the $TE_{10}$ mode at the output of the rectangular waveguide is given by equation (2):

$$\langle \hat{u}(t)^{\dagger}\hat{u}(t)\rangle = \langle \hat{u}(0)^{\dagger}\hat{u}(0)\rangle e^{-\Gamma t} + n_{th}(1 - e^{-\Gamma t}),$$

Where the first term $\langle \hat{u}(0)^{\dagger}\hat{u}(0)\rangle e^{-\Gamma t}$ is the number of $TE_{10}$ signal photons (herein denoted as $M_s$) while the second term is the number of thermally generated noise photons (herein denoted as $M_n$).

Figure 2A:
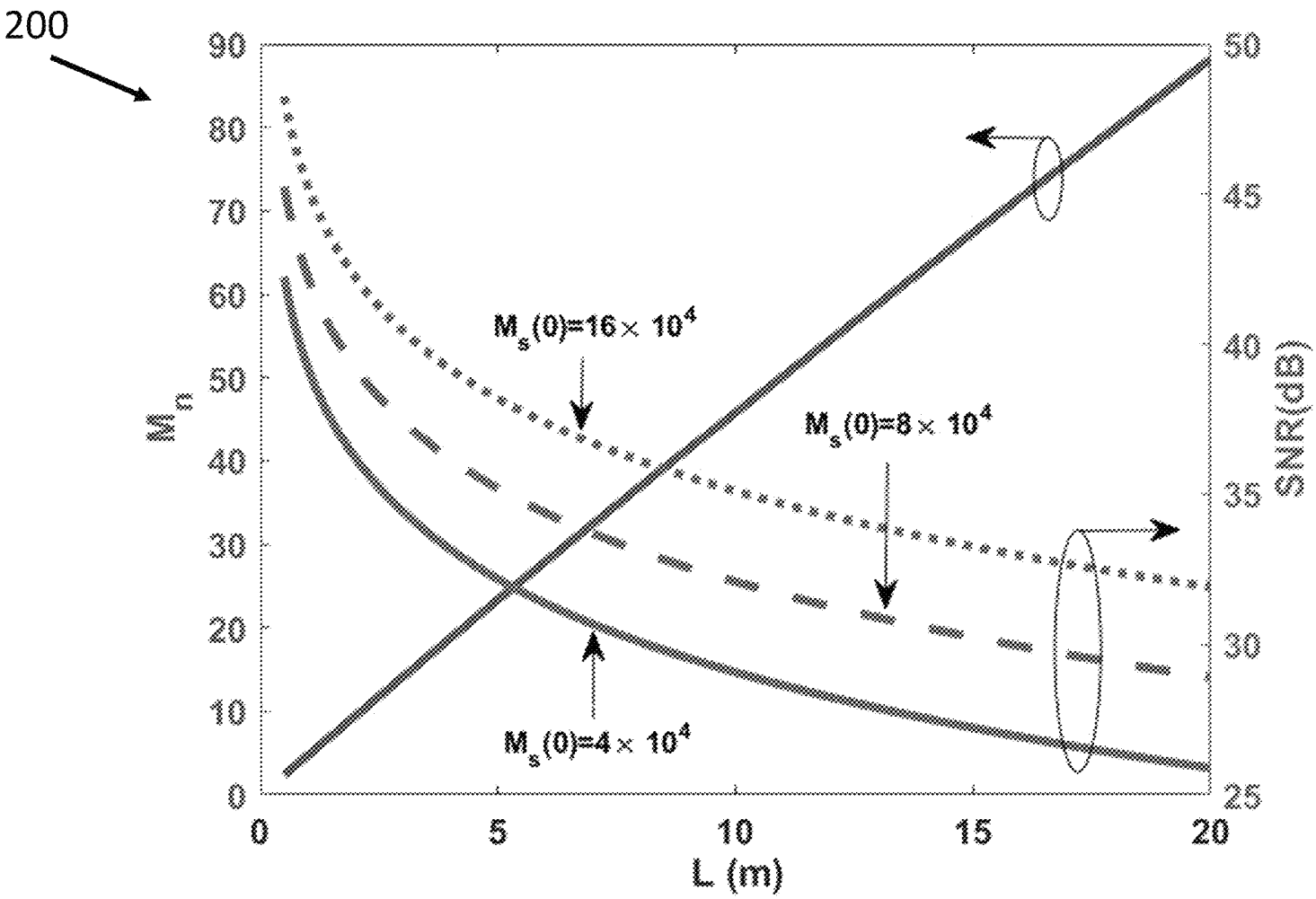
FIGS. 2A and 2B are example electronically generated graphs.
Figure 2B:
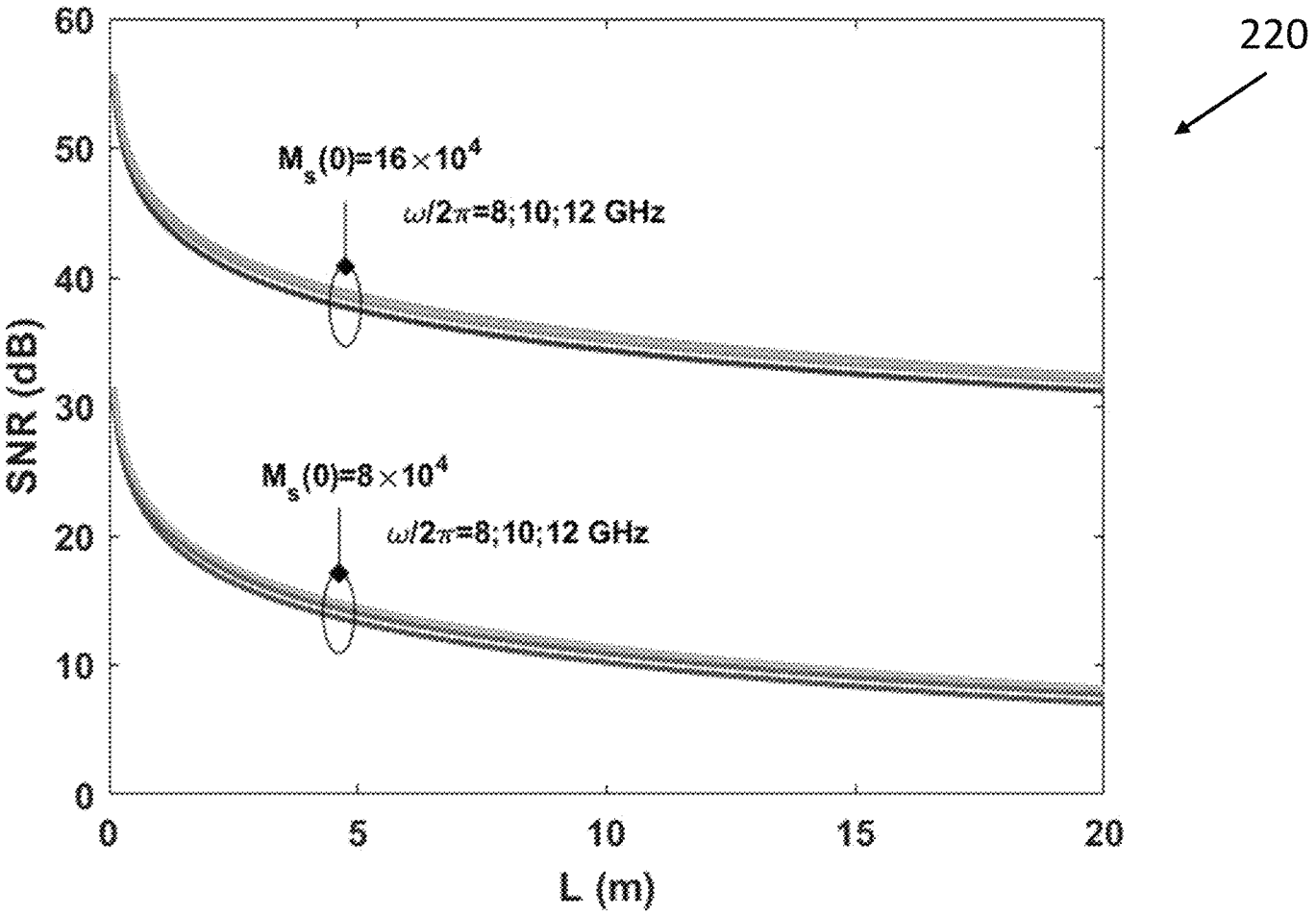

FIG. 2A shows an example electronically generated graph 200. In embodiments, a signal-to-noise ratio (defined as $SNR=M_s/M_n$) with the number of thermally generated photons ($M_n$) determined against the waveguide length. In a non-limiting example, an aluminum rectangular waveguide of five centimeters (cm) width and 2.5 cm height is considered at 20 degrees Celsius temperature. A shown in FIG. 2A, the number of thermally generated noise photons increases against the waveguide length. However, the number of thermally generated noise photons saturates at a specific waveguide length (which is 500 meters in this example). However, the SNR is continuously decreasing, due to attenuation, against the waveguide length. In embodiments, having the SNR greater than zero (0) dB is required to suppress noise. As shown in FIG. 2B, in electronic graph 220, the SNR is shown for different frequencies while considering two different initial number of transmitted signal photons. In embodiments, the SNR is maintained greater than zero (0) dB by having shorter waveguide lengths. In embodiments, longer lengths with SNR greater than zero (0) dB can be maintained by providing a larger initial number of transmitted photons.

In embodiments, for suppressing noise photons and achieve coherent signal transmission, a superconducting loop antenna is implemented inside a waveguide output port and subjected to the $TE_{10}$ mode flux. In embodiments, an LC harmonic oscillator (e.g., LC harmonic oscillator 102) placed outside the waveguide is coupled to the loop antenna (as shown in FIG. 1). In embodiments, the loop antenna induces a voltage across the LC harmonic oscillator based on Faraday's Law of Induction. In embodiments, the antenna and a LC circuit are designed to suppress the noise photons by dictating the number of induced noise photons to be significantly less than one (1). In embodiments, the expression of the induced number of photons across the LC harmonic oscillator is given by equation (3):

$$\langle \hat{b}^{\dagger}\hat{b}\rangle = \eta\langle \hat{u}(0)^{\dagger}\hat{u}(0)\rangle e^{-\Gamma t} + \eta n_{th}(1 - e^{-\Gamma t})$$

In embodiments, the first term, $\eta\langle \hat{u}(0)^{\dagger}\hat{u}(0)\rangle e^{-\Gamma t}$ is the number of induced signal photons (herein denoted as $N_s$) while the second term, $\eta n_{th}(1-e^{-\Gamma t})$, is the number of induced noise photons (herein denoted as $N_n$). In embodiments, $$\eta = \frac{C\omega^2\mu_r^2\mu_0^2 h_r^2 W_r^2}{\frac{1}{2}\Omega^2 lWh\left(\epsilon_{eff} Z_F^2 + \mu_0\mu_r\right)},$$

where C is capacitance, $W_r$ and $h_r$ are width and height, respectively, of the loop antenna. In embodiments, the dimensions of the loop antenna can be designed (by controlling the $\eta$ parameter) to eliminate the induced noise by determining the number of the induced noise photons to be less than one (1). In embodiments, at the same time, the number of signal photons can be maintained by having a particular number of transmitted photons. In embodiments, this can be achieved by a cryogenic pre-amplification.

Figure 3A:
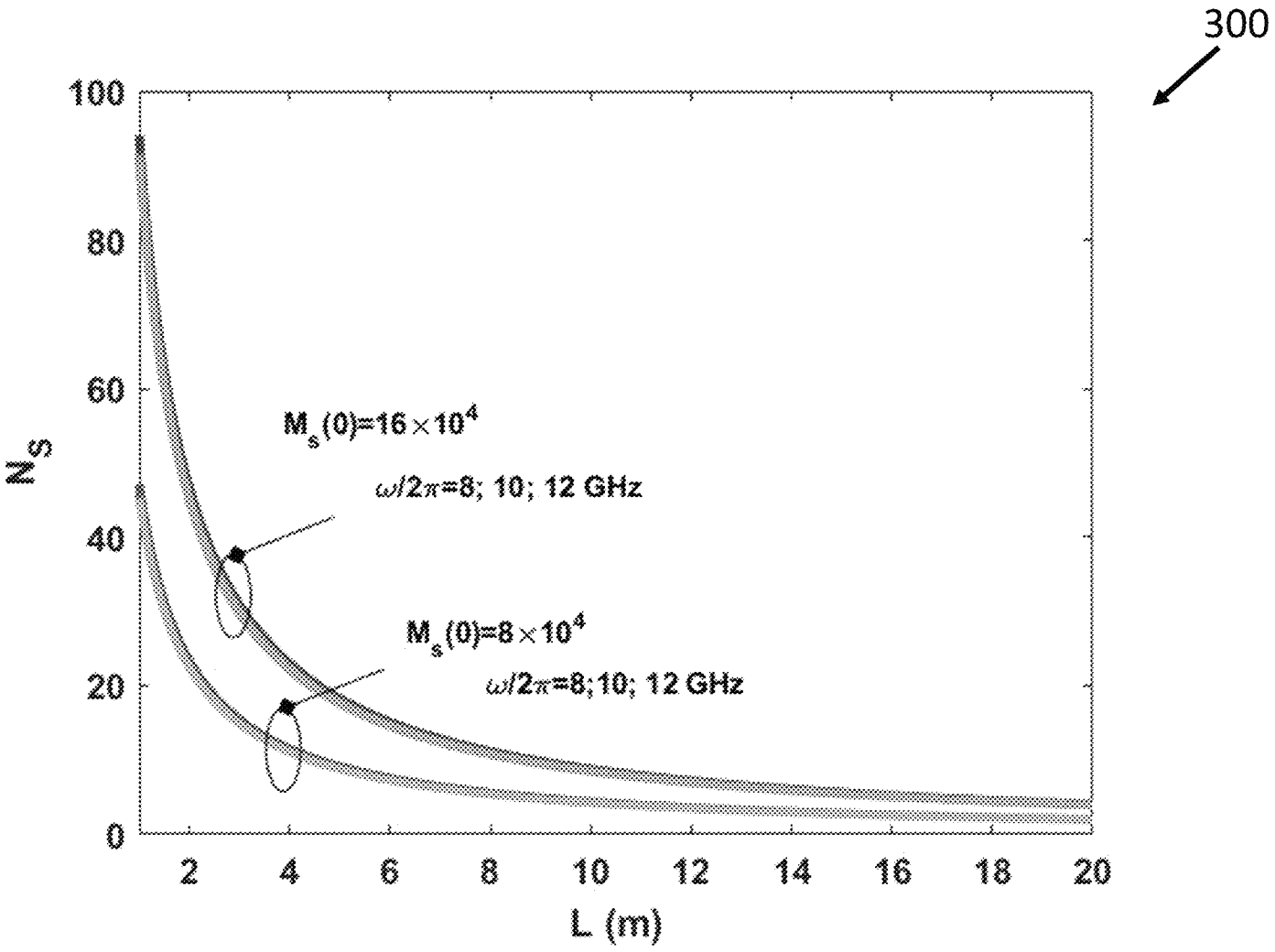
FIGS. 3A and 3B are example electronically generated graphs.
Figure 3B:
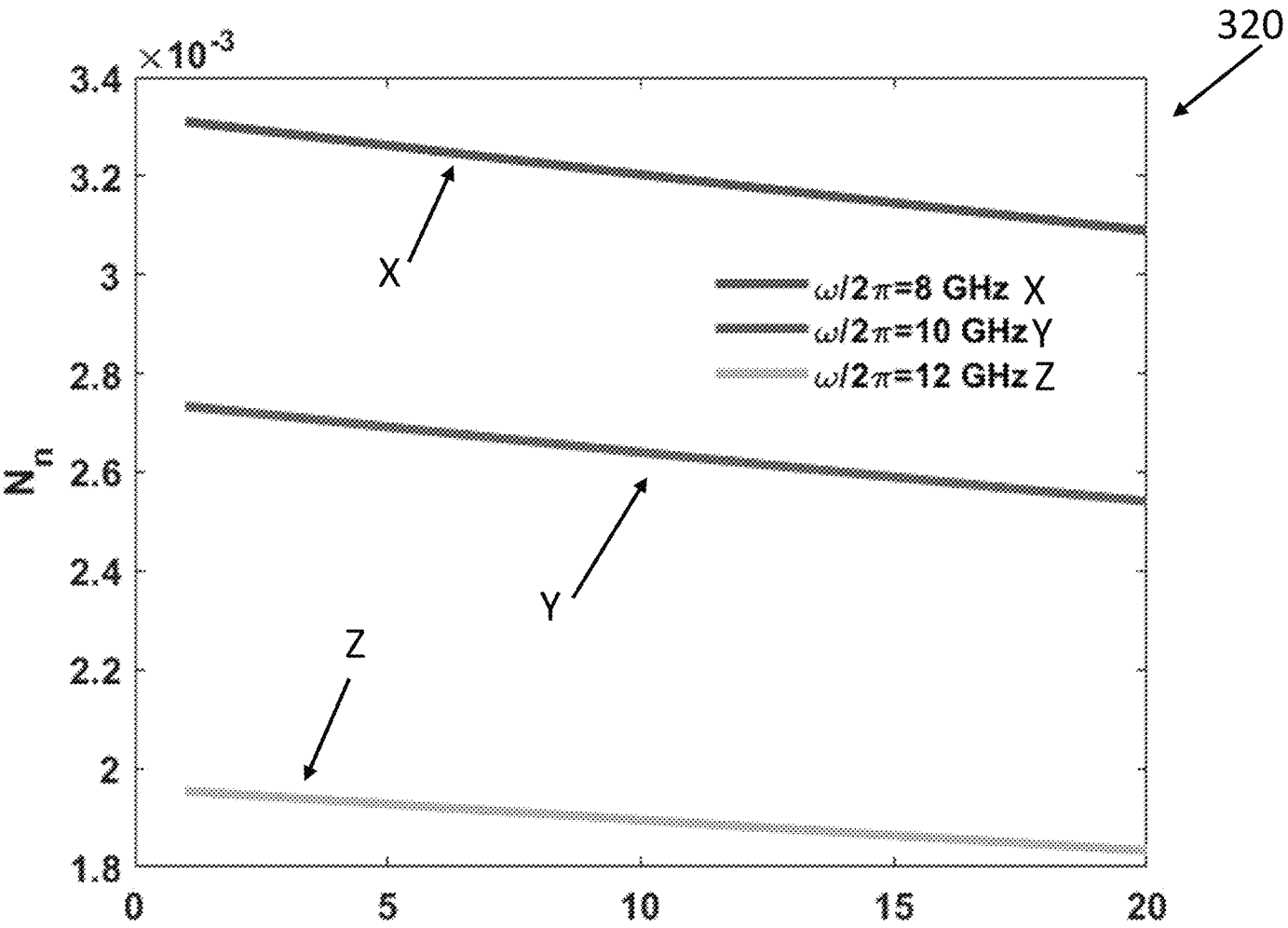

FIGS. 3A and 3B describe electronically generated graphs 300 and 320 that show the number of signal and noise photons induced across the LC harmonic oscillator, respectively. In embodiments, as shown in FIGS. 3A and 3B. the number of noise photons is less than one, while the number of signal photons is maintained greater than one by having a particular number of transmitted photons. In embodiments, meters of transmission lengths (waveguide lengths) can be attained at room temperature.

Figure 4A:
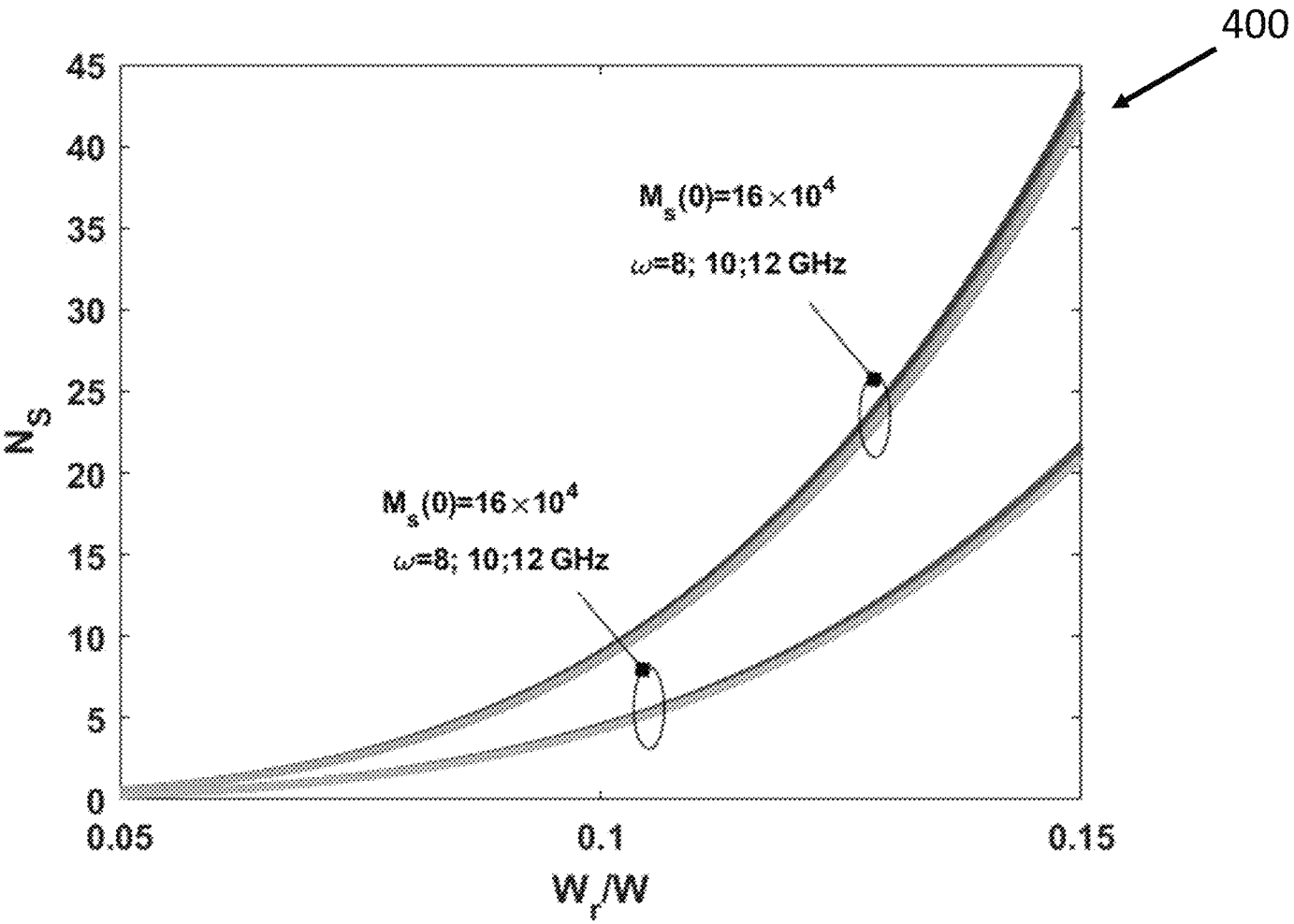
FIGS. 4A and 4B are example electronically generated graphs.
Figure 4B:
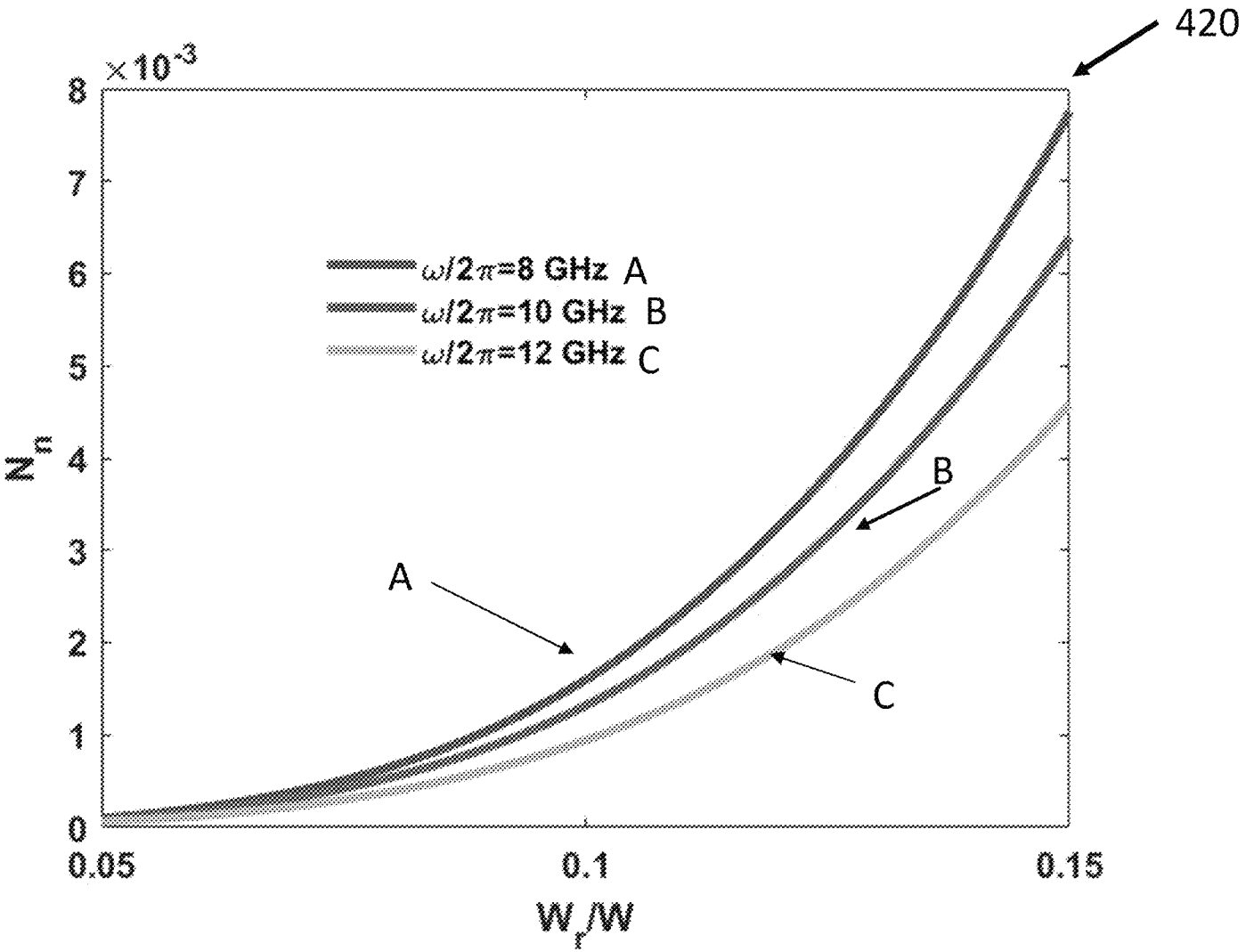

FIGS. 4A and 4B describe electronically generated graphs 400 and 420 that show induced number of signal and noise photons versus the loop antenna-dimension are shown, respectively. As shown in FIGS. 4A and 4B, there is tradeoff between noise suppression and the number of the induced signal photons.

In embodiments, the entire waveguide is operating at the room temperature. In embodiments, there is an over estimation for the generated noise photons as the two terminals of the waveguide are cooled by their physical contacts with the cryostats (e.g., 108 and 110 as shown in FIG. 1) of the superconducting transmitter and receiver circuits.

In embodiments, connecting separated quantum nodes (or processors) by coherent signaling is an efficient approach for efficient scaled quantum computation. As described in the various figures and examples, a direct coherent microwave transmission is occurring without refrigeration. In embodiments, modular quantum computer using waveguides are placed outside the dilution refrigerators with a coherent transmission of a microwave signal of frequency 10 GHz over five (5) meters can be achieved at room temperature by transmitting $8\times10^4$ signal photons at the input of the waveguide. In this non-limiting example, eight (8) coherent photons are received while the number of the noise photons is significantly less than one ($6.3\times10^{-3}$ photons). In embodiments, cryogenic pre-amplification can be utilized at a waveguide input to allow for the needed number of photons.

In embodiments, by providing a mild cooling for the transmission waveguide, the described systems, devices, and methods can be extended to longer transmission distances. In a non-limiting example, by using a liquid nitrogen cooling system, the transmission waveguide temperature can be maintained at 78K temperature. In addition, in this non-limiting example, the transmission length canbe extended to 35 meters with the same number of received coherent signal photons and suppressed noise photons. Accordingly, modular superconducting quantum computer can be designed with the potential of thousands, or millions, of qubits.

In a non-limiting example, consider a microwave waveguide with a rectangular cross-sectional sectional geometry of width W along thex-axis, and a height h along the y-axis. In this non-limiting example, electric and magnetic fields expressions associated witha fundamental $TE_{10}$ mode of this waveguide is given by equations (4) and (5):

$$\vec{E}(x, y, x, t) = iAZ_F\Omega\sin\left(\frac{\pi x}{W}\right)e^{(i\beta z-\omega t)}\vec{e_y} + c.c. \tag{4}$$

$$\vec{H}(x, y, z, t) = -iA\sqrt{\Omega^2-1}\sin\left(\frac{\pi x}{W}\right)e^{(i\beta z-\omega t)}\vec{e_x} + A\sqrt{\Omega^2-1}\sin\left(\frac{\pi x}{W}\right)e^{(i\beta z-\omega t)}\vec{e_z} + c.c. \tag{5}$$

where A is the complex amplitude of the $TE_{10}$ mode, $$Z_F = 377\sqrt{\frac{u_r}{\in_r}}$$

is the impedance of a filing material and $$\Omega = \frac{\omega}{\omega_c}.$$

In embodiments, ω is a microwave signal frequency, $$\omega_c = \frac{2\pi c}{2W\sqrt{\in_r}}$$

is a cutoff frequency, and $\mu_r$ and $\epsilon_r$ are the relative permeability and permittivity of the filing material, respectively, β is the propagation constant, and c is the speed of light in a vacuum.

In embodiments, the classical Hamiltonian of the $TE_{10}$ mode is given by $H=\frac{1}{2}\in_0\in_{eff}|A|^2Z_F^2\Omega^2V_{ol}+\frac{1}{2}\mu_0\mu_{eff}|A|^2\Omega^2V_{ol}$, where $V_{ol}=W\times h\times l$ is a waveguide volume and l is a waveguide length. In embodiments, the propagating microwave field can be quantized through the following relationship in equation (6):

$$A = \frac{(hw)^{\frac{1}{2}}}{\varphi^{\frac{1}{2}}(\in_0\ \in_{eff}\ V_{ol})^{\frac{1}{2}}}\hat{\alpha}$$

In embodiments, â is an annihilation operator of the $TE_{10}$ mode, $$\varphi = \frac{\Omega^2 Z_F^2}{2} + \frac{\mu_0\mu_r\Omega^2}{2\in_0\ \in_{eff}},\ \text{and}\ \in_{eff} = \in_r - \frac{\pi^2c^2}{W^2\omega^2}$$

is an effective permittivity of the waveguide. Accordingly, $\hat{H} = h\omega\hat{a}^{\dagger}\hat{a}$. In embodiments, the motion equation can be found by substituting the quantum Hamiltonian into the Heisenberg equation, $$\frac{\partial\hat{a}}{\partial c} = \frac{i}{h}[\hat{H}, \hat{a}],$$

resulting in $$\frac{\partial\hat{a}}{\partial t} = -i\omega\hat{a} - \frac{\gamma}{2}\hat{a} + \sqrt{\Gamma}\,\hat{n}.$$

In embodiments, by implementing a rotation approximation by setting $\hat{a}=\hat{u}e^{(-i\omega t)}$, the motion equation is equation (7) as follows:

$$\frac{\partial\hat{u}}{\partial T} = -\frac{\gamma}{2}\hat{u} + \sqrt{\Gamma}\,\hat{n}$$

In embodiments, $\gamma=\alpha/v_g$ is a decay time coefficient, with $$\alpha = \frac{2R_S}{\sqrt{\frac{\mu_0\mu_r}{\in_0\ \in_r}}}\frac{\frac{h}{W}\left(\frac{\omega_r}{\omega}\right)^2-1}{\sqrt{1-\left(\frac{\omega_r}{\omega}\right)^2}}$$

as the attenuation coefficient, $$v_g = c\sqrt{1-\left(\frac{\omega_r}{\omega}\right)^2}$$

is the group velocity, and n̂ is the quantum Langevin noise operator. In embodiments, $R_s$ is the surface impedance of the waveguide metal material.

In embodiments, a superconducting loop antenna of width $W_r$ along the x-axis and height $h_r$ along the y-axis is implemented at the output port of the waveguide and is subjected to a $TE_{10}$ flux. In embodiments, the loop antenna (e.g., using a $NbT_i$) is coupled to a LC harmonic oscillator.

In embodiments, classically, the induced voltage across the LC circuit can be described by Faraday's law of induction, and given by equation (8) as follows:

$$V(t) = -\frac{\partial \psi}{\partial t}$$

In embodiments, $\psi=\int_0^{W_r}\int_0^{h_r}\vec{H}(x, y, z, t)\cdot\partial\vec{A}$ is the flux subjected to a loop antenna and $\partial\vec{A}=\partial x\partial y\vec{e_z}$ is the differential element of the antenna's enclosed area. In embodiments, it follows that the induced voltage across the LC circuit is given by $V(t)=V_I e^{-\omega t+i\beta L}$+c.c. where $V_I$ is the induced voltage amplitude and is given by equation (9) as:

$$V_I=i\mu_0\mu_r Ah_r W_r$$

In embodiments, the voltage across the LC circuit can be quantized through the following equation as shown in equation (10):

$$V_I = \sqrt{\frac{h\omega}{C}}\,\hat{b}$$

In embodiments, $\hat{b}$ is the annihilation operator of the voltage in the LC harmonic oscillator, C is the capacitance, $$\omega = \frac{1}{\sqrt{LC}}$$

and L is the inductance. In embodiments, by using equation (6) and equation (10), a direct relation between the annihilation operators of the $TE_{10}$ mode and the LC voltage can be established by equation (11) as follows:

$$\hat{b} = i\hat{a}\frac{C^{\frac{1}{2}}}{\varphi^{\frac{1}{2}}(\in_0\ \in_{eff}\ V_{ol})^{\frac{1}{2}}}\mu_0\mu_r\omega h_r W_r$$

Figure 5:
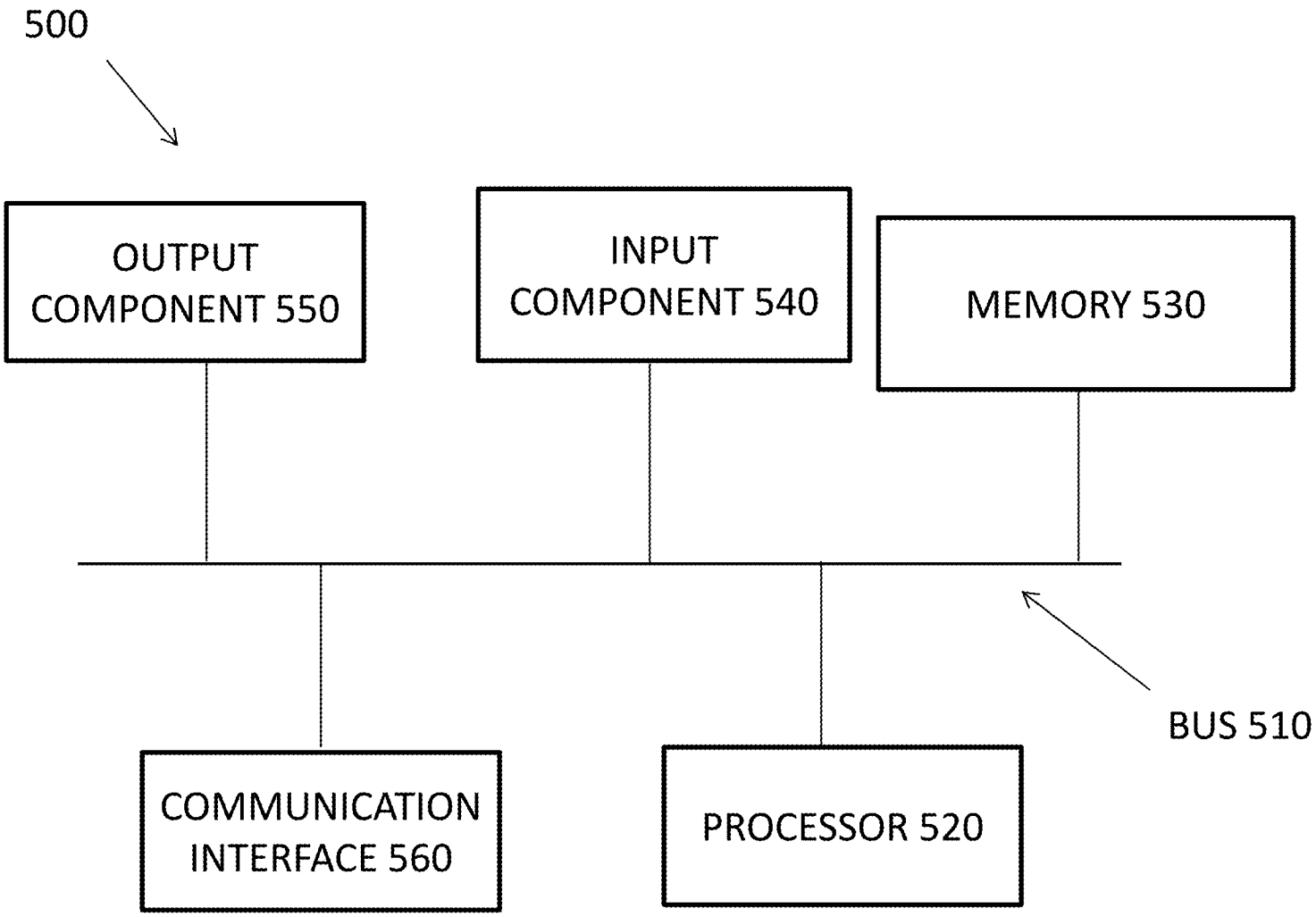
FIG. 5 is an example computing device.

FIG. 5 is a diagram of example components of a device 500. Device 500 may correspond to a computing device, such as devices 600. Alternatively, or additionally, devices 600 may include one or more devices 500 and/or one or more components of device 500.

As shown in FIG. 5, device 500 may include a bus 510, a processor 520, a memory 530, an input component 540, an output component 550, and a communications interface 560. In other implementations, device 500 may contain fewer components, additional components, different components, or differently arranged components than depicted in FIG. 5. Additionally, or alternatively, one or more components of device 500 may perform one or more tasks described as being performed by one or more other components of device 500.

Bus 510 may include a path that permits communications among the components of device 500. Processor 520 may include one or more processors, microprocessors, or processing logic (e.g., a field programmable gate array (FPGA) or an application specific integrated circuit (ASIC)) that interprets and executes instructions. Memory 530 may include any type of dynamic storage device that stores information and instructions, for execution by processor 520, and/or any type of non-volatile storage device that stores information for use by processor 520. Input component 540 may include a mechanism that permits a user to input information to device 500, such as a keyboard, a keypad, a button, a switch, voice command, etc. Output component 550 may include a mechanism that outputs information to the user, such as a display, a speaker, one or more light emitting diodes (LEDs), etc.

Communications interface 560 may include any transceiver-like mechanism that enables device 500 to communicate with other devices and/or systems. For example, communications interface 560 may include an Ethernet interface, an optical interface, a coaxial interface, a wireless interface, or the like.

In another implementation, communications interface 560 may include, for example, a transmitter that may convert baseband signals from processor 520 to radio frequency (RF) signals and/or a receiver that may convert RF signals to baseband signals. Alternatively, communications interface 560 may include a transceiver to perform functions of both a transmitter and a receiver of wireless communications (e.g., radio frequency, infrared, visual optics, etc.), wired communications (e.g., conductive wire, twisted pair cable, coaxial cable, transmission line, fiber optic cable, waveguide, etc.), or a combination of wireless and wired communications.

Communications interface 560 may connect to an antenna assembly (not shown in FIG. 5) for transmission and/or reception of the RF signals. The antenna assembly may include one or more antennas to transmit and/or receive RF signals over the air. The antenna assembly may, for example, receive RF signals from communications interface 560 and transmit the RF signals over the air, and receive RF signals over the air and provide the RF signals to communications interface 560. In one implementation, for example, communications interface 560 may communicate with a network (e.g., a wireless network, wired network, Internet, etc.).

As will be described in detail below, device 500 may perform certain operations. Device 500 may perform these operations in response to processor 520 executing software instructions (e.g., computer program(s)) contained in a computer-readable medium, such as memory 530, a secondary storage device (e.g., hard disk, CD-ROM, etc.), or other forms of RAM or ROM. A computer-readable medium may be defined as a non-transitory memory device. A memory device may include space within a single physical memory device or spread across multiple physical memory devices. The software instructions may be read into memory 530 from another computer-readable medium or from another device. The software instructions contained in memory 530 may cause processor 520 to perform processes described herein. Alternatively, hardwired circuitry may be used in place of or in combination with software instructions to implement processes described herein. Thus, implementations described herein are not limited to any specific combination of hardware circuitry and software.

Figure 6:
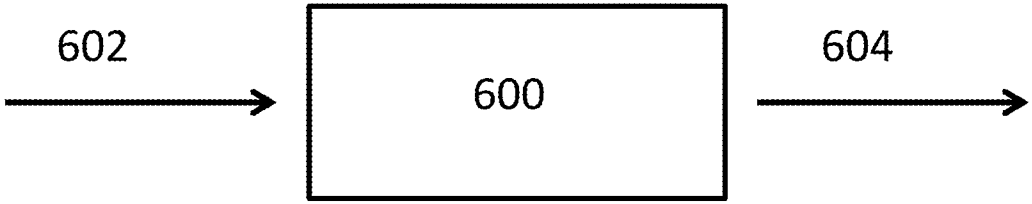
FIG. 6 is an example computing device.

FIG. 6 is an example diagram. FIG. 6 describes device 600, communication 602, and communication 604. In embodiments, device 600 may a computing device with features/structures similar to that described in FIG. 6. In embodiments, device 600 may be a computing device that is part of a laptop, desktop, tablet, smartphone, and/or any other device that may receive communication 602, analyze communication 602, and generate output 604 based on communication 602. As shown in FIG. 6, communication 602 may be received by device 600 (e.g., via keyboard inputs, touchscreen inputs, voice inputs, etc.). In embodiments, communication 602 may include information about a waveguide, LC harmonic oscillator, and/or other features.

In embodiments, device 600 may receive communication 602 and, based on one or more of equations (1) to (11), as described above, that generate output 604 that includes information about waveguide length, loop design features, and/or other information associated with equations (1) to (11).

In embodiments, various analysis and computerized simulation tools can be used to investigate temperature distribution as well as the microwave propagation along the waveguide. In a non-limiting example, an aluminum waveguide of five (5) meters in length and 5 centimeters (cm) by 2.5 cm cross sectional area of the waveguide is considered. In this non-limiting example, the boundary conditions are 3 mK at the two waveguide ends while the ambient along the waveguide is considered at room temperature (e.g., around 20 degrees Celsius). Furthermore, in this non-limited example, estimations for the added noise of pre-amplifiers are made to show that the thermally generated noise during transmission is substantially dominating the noise generation at the receiver side.

Figure 7A:
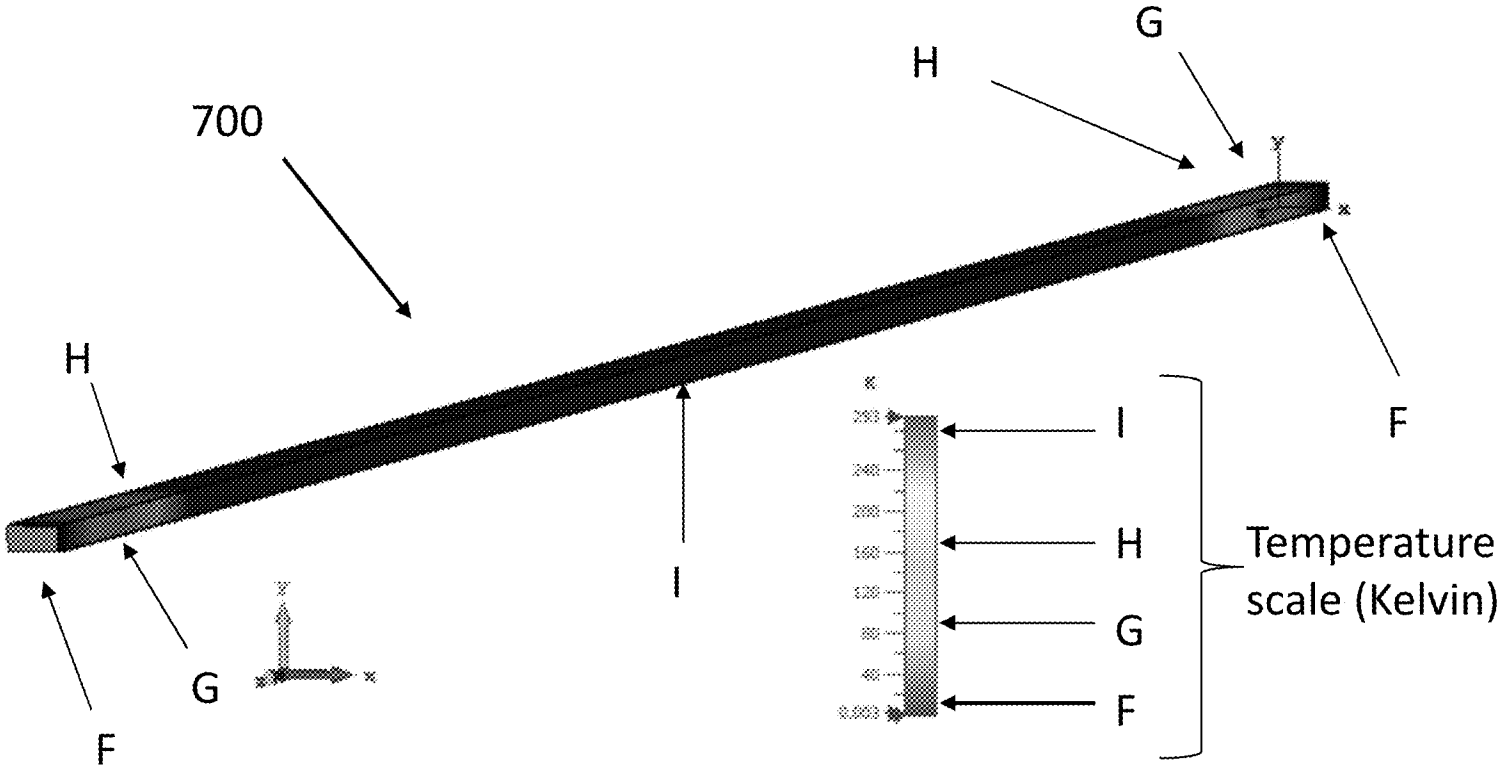
FIGS. 7A and 7B are example descriptions of simulations relating to a waveguide.
Figure 7B:
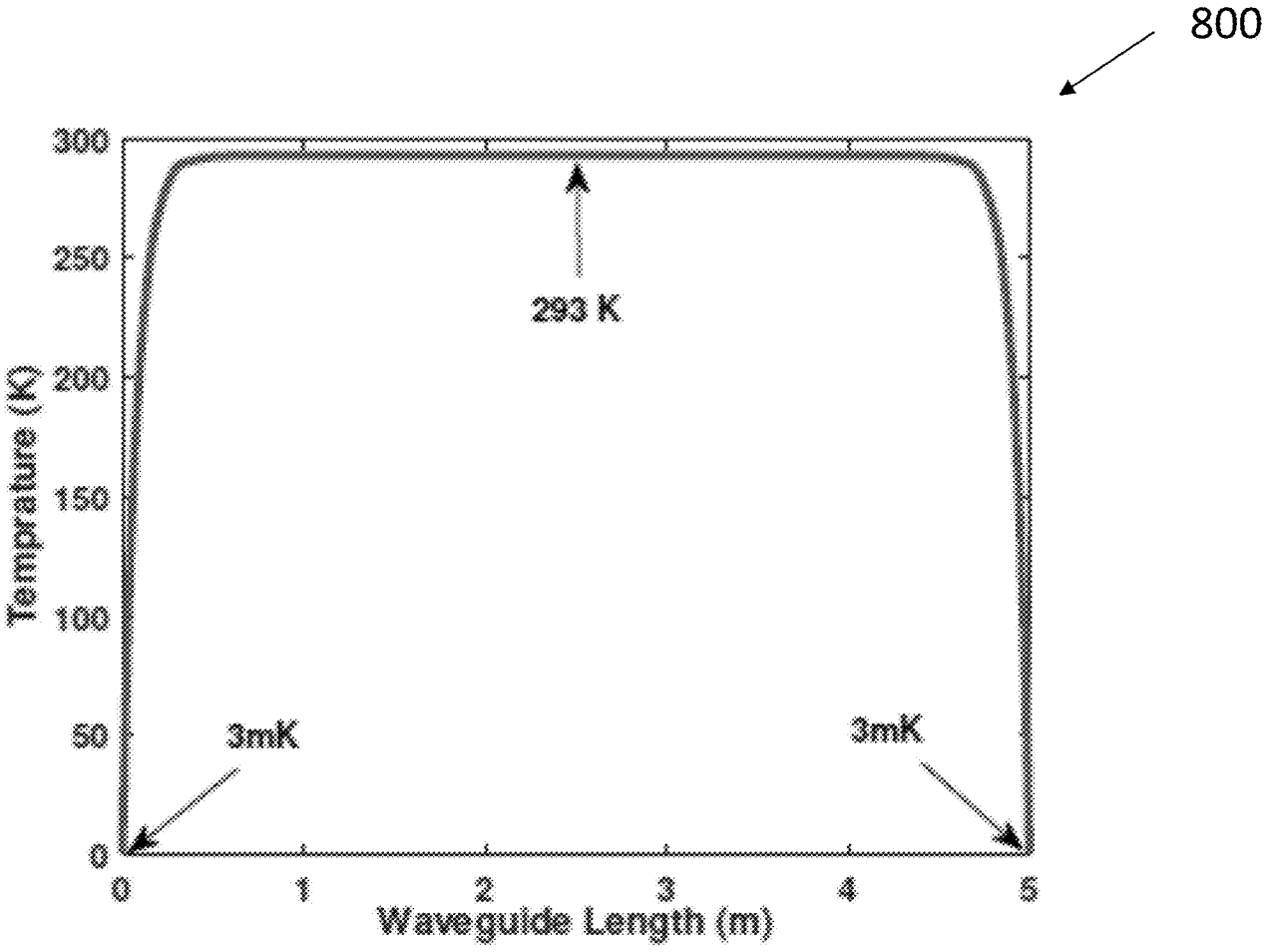

As shown in FIG. 7A, a temperature simulation is presented describing the steady-state temperature distribution along a waveguide. The temperatures shown in FIG. 7A, begin with A indicating the lowest temperature (at 0.003 Kelvin) on the shown temperature scale and D showing the highest temperature on the scale (at or near a room temperature of 20 degrees Celsius or 293 Kelvin). As further shown in FIG. 7A, these temperatures (F, G, H, and I) are then shown at various points on waveguide 700 with F temperatures for those parts of the waveguide in cryostats and I temperature for those parts of the waveguide that are at or near room temperature. As shown in FIG. 7B, the numerical value of the temperature distribution versus the waveguide length is shown (as graph 800) for the waveguide example in FIG. 7A. As shown in FIG. 7B, the temperature reaches a constant value, that is about room temperature, after 40 cm from each end side of the waveguide.

In a non-limiting example, the microwave propagation is simulated under the temperature distributions shown in FIGS. 7A and 7B. In this non-limiting example, a microwave signal of 10 GHz is considered. In this non-limiting example, simulations show that there are no notable changes in the microwave signal propagation in the considered waveguide as compared to the same waveguide with uniform room temperature distribution. In this non-limiting example, several additional simulations for different microwave frequencies are considered. Again, no variations in the microwave signal propagation occur due to the temperature distribution as compared to entirely room temperature conditioned waveguides.

In embodiments, superconducting quantum circuits, placed in dilution refrigerators, the signal amplification is composed of two stages. In embodiments, the first stage is conducted at few milli-Kelvin cryogenic temperature using a traveling wave parametric (TWPA) amplifier. In embodiments, the second stage is conducted at a Kelvin cryogenic temperature (e.g., 3 Kelvin) using a cryogenic low-noise amplifier. In embodiments, in an example transmission system, as described in one or more figures, the contribution of the noise generated by the cryogenic pre-amplifiers (named hereafter as the amplification-noise) to the detected noise level at the receiver is negligibly small as compared to the thermally generated photons during transmission.

In a non-limiting example, for a quantum signal of 10 photons and 10' noise photons (such as generated by a source processor at the transmitter), the launched noise to the waveguide input port is 8.101 amplification noise photons (for an amplified signal of $8\times10^4$ photons). In this non-limiting example, a TWPA amplifier of 10 dB gain occurs, and an off-the-shelf commercially available cryogenic amplifier of 29 dB gain and 0.055 dB Noise-Figure. Accordingly, it follows that the number of the amplification-noise photons at the output port of 5 meters waveguide is 7.792. As such, the number of the induced amplification-noise photons across the LC circuit at the receiver is 2.24×10'. Thus, this number of induced amplification-noise photons across the LC circuit is a negligible contribution as compared to the thermally generated noise photons during transmission (such as 8.8%).

Even though particular combinations of features are recited in the claims and/or disclosed in the specification, these combinations are not intended to limit the disclosure of the possible implementations. In fact, many of these features may be combined in ways not specifically recited in the claims and/or disclosed in the specification. Although each dependent claim listed below may directly depend on only one other claim, the disclosure of the possible implementations includes each dependent claim in combination with every other claim in the claim set.

While various actions are described as selecting, displaying, transferring, sending, receiving, generating, notifying, and storing, it will be understood that these example actions are occurring within an electronic computing and/or electronic networking environment and may require one or more computing devices, as described in FIG. 5, to complete such actions. Furthermore, it will be understood that these various actions can be performed by using a touch screen on a computing device (e.g., touching an icon, swiping a bar or icon), using a keyboard, a mouse, or any other process for electronically selecting an option displayed on a display screen to electronically communicate with other computing devices. Also, it will be understood that any of the various actions can result in any type of electronic information to be displayed in real-time and/or simultaneously on multiple user devices. For FIGS. 2A, 2B, 3A, 3B, 4A, 4B, and 7B, the electronic graphs may be generated by a computing device, such as device 500, and displayed via a graphical user device (GUI).

No element, act, or instruction used in the present application should be construed as critical or essential unless explicitly described as such. Also, as used herein, the article "a" is intended to include one or more items and may be used interchangeably with "one or more." Where only one item is intended, the term "one" or similar language is used. Further, the phrase "based on" is intended to mean "based, at least in part, on" unless explicitly stated otherwise.

In the preceding specification, various preferred embodiments have been described with reference to the accompanying drawings. It will, however, be evident that various modifications and changes may be made thereto, and additional embodiments may be implemented, without departing from the broader scope of the invention as set forth in the claims that follow. The specification and drawings are accordingly to be regarded in an illustrative rather than restrictive sense.

What is claimed is:

1. An apparatus, comprising:

a waveguide;

a first circuit;

a second circuit, wherein the waveguide is connected to the first circuit and the second circuit, wherein the first circuit is located within a cryostat.

2. The apparatus of claim 1, wherein the second circuit is located within another cryostat.

3. The apparatus of claim 1, wherein the waveguide is located at room temperature.

4. The apparatus of claim 1, wherein the second circuit is a loop antenna coupled to a LC harmonic oscillator.

5. The apparatus of claim 1, wherein the first circuit is a cryogenic preamplification transmitter.

6. The apparatus of claim 1, wherein induced voltages in the second circuit includes a transmitted signal and thermally generated noise.

7. The apparatus of claim 1, wherein the loop antenna is a superconducting loop antenna.

8. The apparatus of claim 1, wherein the apparatus generates noise photons that are less than one.

9. The apparatus of claim 8, wherein the apparatus generates signal photons greater than one.

* * * * *